US006581354B1

(12) United States Patent
Skarpness

(10) Patent No.: US 6,581,354 B1
(45) Date of Patent: Jun. 24, 2003

(54) GLASS CURTAIN WALL SYSTEM

(76) Inventor: Larry S. Skarpness, 13194 Maple Island Dr., SE., Glenwood, MN (US) 56334

( * ) Notice: Subject to any disclaimer, the term of this patent is extended or adjusted under 35 U.S.C. 154(b) by 0 days.

(21) Appl. No.: 09/344,738

(22) Filed: Jun. 25, 1999

(51) Int. Cl.[7] ..... E04B 1/62
(52) U.S. Cl. ..... 52/773; 52/774; 52/781.3
(58) Field of Search ..... 52/773, 774, 781.3

(56) References Cited

U.S. PATENT DOCUMENTS

| | | | | | |
|---|---|---|---|---|---|
| 1,793,127 | A | * | 2/1931 | Osius | 52/772 |
| 2,171,319 | A | * | 8/1939 | Williams | 52/464 |
| 2,342,352 | A | * | 2/1944 | Lowry | 52/770 |
| 2,400,421 | A | * | 5/1946 | Johnson | 52/204.597 |
| 2,604,061 | A | * | 7/1952 | Estey | 52/204.593 |
| 2,617,159 | A | * | 11/1952 | Leighton | 52/204.593 |
| 2,803,321 | A | * | 8/1957 | Fox-Williams | 52/464 |
| 4,650,702 | A | * | 3/1987 | Whitmyer | 428/31 |
| 4,843,773 | A | * | 7/1989 | Richter | 52/204.591 |
| 4,854,098 | A | * | 8/1989 | Emmer | 52/204.593 |
| 4,905,435 | A | * | 3/1990 | Horst | 52/235 |
| 5,016,410 | A | * | 5/1991 | Moch | 52/235 |
| 5,199,236 | A | * | 4/1993 | Allen | 52/235 |
| 5,632,125 | A | * | 5/1997 | Osanai | 52/235 |

* cited by examiner

*Primary Examiner*—Gregory J. Strimbu

(57) ABSTRACT

A glass curtain wall connective support system that includes a connective aluminum shape with an integral slot, which is configured to index with an outer facing leg or projection from a curtain wall frame support structure. The connective aluminum shape is bonded to a glass pane assembly, preferably under factory conditions. The curtain wall frame support structure is affixed to a secure structural element of a building. The glass pane assembly, bonded with the connective aluminum shape, is then indexed with the curtain wall frame support structure, and then secured with one or more snap clamps. The connective aluminum shape provides a rapid and secure attachment for a plurality of glass panes to a curtain wall frame supporting structure.

2 Claims, 5 Drawing Sheets

GLASS CURTAIN WALL SYSTEM

BACKGROUND OF THE INVENTION

1. Field of the Invention

This invention relates generally to curtain wall window frames using a structural silicone bond between the glass pane assembly and the supporting curtain wall frame, and more specifically to a small connective aluminum shape that can be bonded to a glass pane assembly in a factory and which serves as a vehicle for quickly and securely affixing multiple glass pane assemblies to curtain wall window frames that encompass the outer perimeter of a building thus forming a flush glass pane curtain wall surface.

2. Description of the Related Art

A common architectural trend has been to structurally affix glass pane assembles through the use of a silicone bond to a curtain wall support frame attached to the outer perimeter of a wide variety of styles and types of buildings. A structural silicone bonded glass curtain wall is typically made up of many panes of glass which are affixed to the outer surface of the building which in turn define the outer and visible portion of the building. Such a glass curtain wall may encompass the entire structure giving the illusion of a glass building or simply occur over a small portion of the building. Functionally, the glass curtain wall also provides the windows for the building.

Certain problems are inherent any time current methods of installing the silicone bond between the glass and supporting curtain wall frames as used in a structural silicone glazed curtain wall structure. The glass pane assemblies must somehow be securely affixed to the curtain wall frame structure on the building. They must be able to flex in response to the seismic motion of the building as well as forces generated by high winds. The current available method of installing the silicone bond between the glass and curtain wall frame supporting structure is by temporarily clamping each glass pane assembly to the curtain wall frame supporting structure on the side of a building. Once clamped, each surface of the glass pane assembly and the curtain wall frame supporting structure is then carefully cleaned before installing the silicone bond. If any dirt or oil is left on the surface to be bonded during the cleaning process the silicone bond can release under high wind loads thus causing the glass pane assembly to break or become dislodged and fall from the curtain wall frame supporting structure.

One solution that deals with the installation of the silicone bond on the building is the use of a screw on clamp that has been bonded to the glass. While avoiding problems of on-site silicon bonding, this approach makes the installation of the glass curtain complicated and time consuming. One specific complication arises due to the need to provide so many screws. The high number being necessary to resist high wind loads. Even with the large number of screws, the system has questionable structural reliability due to the configuration that is required, namely providing access to the screws.

Another previous solution is the installation of several glass pane assemblies with a silicone bond on a pre-assembled curtain wall frame structure at a frame manufacturing shop or warehouse. This is also a slow process and takes special care for the handling of this large frame (usually 5'×13') until the silicone is cured. Obviously, the glass panes must be bonded to some type of curtain wall frame support structure. Often this bonding process will be conducted in the field or on the job site, thus greatly reducing the quality and accuracy of the silicone bonding process. As can be imagined, it is very difficult to control dirt and dust in these conditions. This is especially problematic when one considers that large amounts of silicone are to be used in the bonding process.

Therefore, there exists a need to provide a sound, structural silicone bonded curtain wall support system, which allows for the quick and easy securement of structural silicone bonded glass pane assemblies to the curtain wall frame supporting structure. Furthermore, there exists a need to provide such a system wherein the glass pane assemblies may be bonded with silicone to a connective aluminum shape under factory-controlled conditions.

SUMMARY OF THE INVENTION

The present invention is a connective aluminum shape which includes an inward facing integral slot or recess that prevents rotation of the connective aluminum shape when indexed with an outward facing leg on the curtain wall frame structure. The connective aluminum shape also provides alignment between the glass pane assembly and the supporting curtain wall window frame structure. The connective aluminum shape is bonded with silicone to the inner surface of a glass pane assembly along all four sides or at least along a portion of a glass pane assembly's perimeter. Additionally, the connective aluminum shape is bonded to the glass pane assembly under uniformly controlled factory conditions thus assuring both accurate alignment and a quality bond.

The glass pane assembly with the silicone bonded connective aluminum shape is then brought to the building site. The connective aluminum shape cooperates with a curtain wall frame support structure that can be securely attached to a permanent portion of the building such as a floor edge or a beam. The connective aluminum shape is configured to extend around the entire perimeter of the curtain wall frame openings in the preferred embodiment. Extending from the curtain wall frame support structure is a leg which projects outwardly from the curtain wall frame support structure and again is provided around the entire perimeter of the curtain wall glass pane assembly opening in the preferred embodiment. The leg projecting from the curtain wall frame support structure is caused to index with the corresponding integral slot or recess provided in the connective aluminum shape. Subsequently when the glass pane assembly with this connective aluminum shape is fully indexed, a continuous snap clamp is installed at each glass pane assembly perimeter thus quickly securing the factory bonded glass pane assembly and connective aluminum shape to the curtain wall frame support structure preventing the glass pane assembly from being separated from the building It is an object of the present invention to provide a glass pane assembly that is silicone bonded to a connective aluminum shape which is installed quickly on a curtain wall window support frame attached to a building without the time consuming process of installing this critical silicone bond to the glass pane assembly on the curtain wall frame supporting structure on the building at the job site.

It is a further object of the invention to prevent rotation of the connective aluminum shape under high wind loads or other movement by the use of a slot or recess that indexes with a leg on the curtain wall frame supporting structure. This connective aluminum shape will allow all movement of the curtain wall frame support structure while still retaining the silicone bonded glass pane assembly in place. Further, the leg indexing with the integral slot in the connective aluminum shape prevents rotation.

It is yet another object of the invention to provide a quality controlled factory bonded structural silicone glazed glass curtain wall system.

DETAILED DESCRIPTION OF PREFERRED EMBODIMENTS

Figure 1:
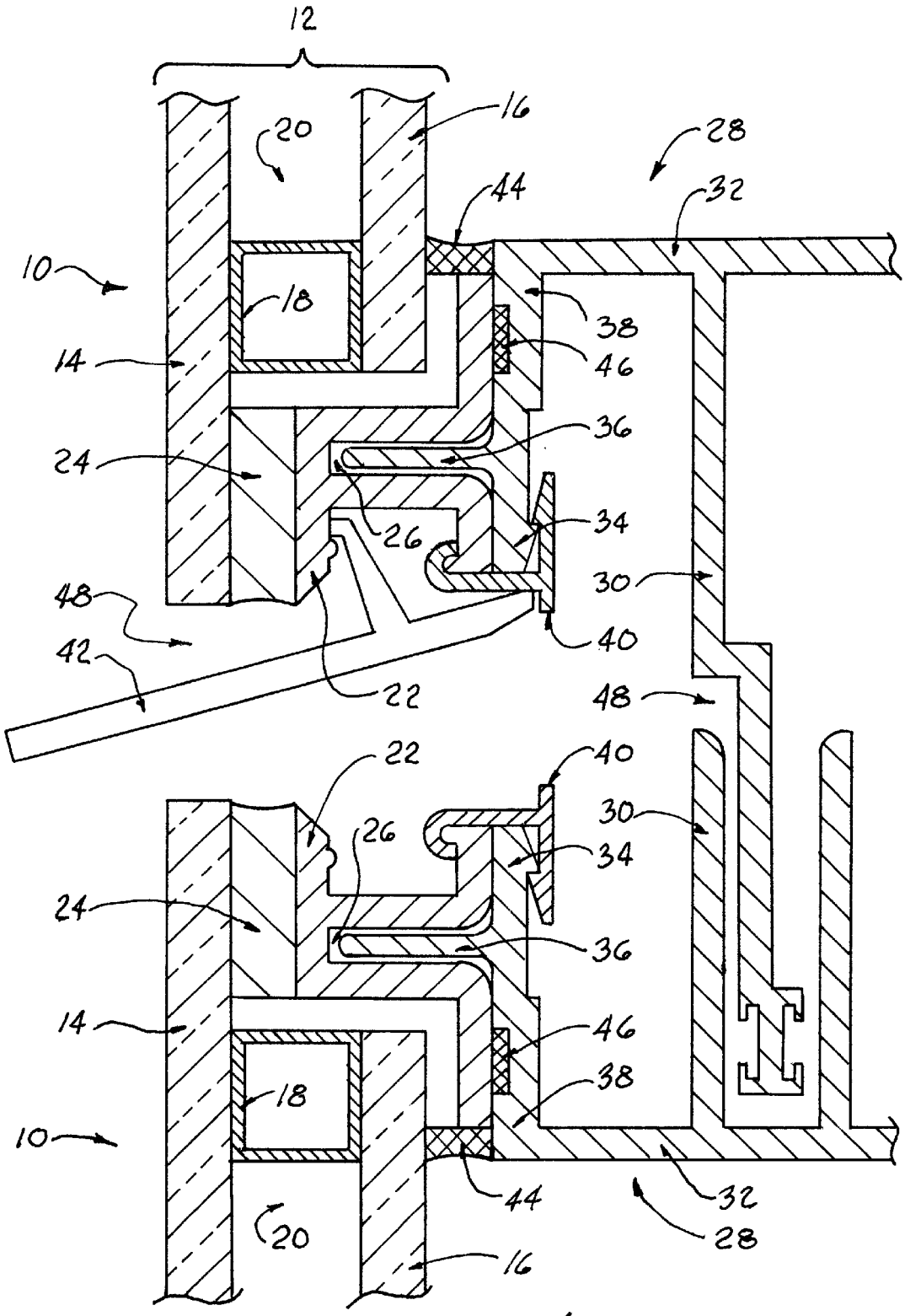
FIG. 1 is a side sectional view of two abutting glass pane assemblies secured or partially secured to the curtain wall frame support structure.

Referring to FIG. 1, a glass curtain wall frame structure is illustrated and generally referred to as 10. It is to be understood that the drawings are for illustrative purposes only. As such, the relative sizes and proportions of the components illustrated are not meant to be limiting and may be skewed to include a complete concept. Glass pane assembly 12 includes an outer pane of glass 14 and an inner pane of glass 16 which are adhered together and separated by spacer 18. The use of spacer 18 provides a thermal barrier 20 between the two panes of glass which exhibits known insulation properties. For purposes of the present invention known as the connective aluminum shape 22, any curtain wall frame structure 10 may be used. That is, single panes of glass or any combination of multiple panes of glass could be utilized herein. The glass pane assembly 12 is securely affixed to a connective aluminum shape 22. In the preferred embodiment, the connective aluminum shape 22 is bonded to the glass pane assembly 12 with structural silicone 24 and the connective aluminum shape 22 is fabricated to surround the entire perimeter of glass pane assembly 12. Alternatively, no other silicone 24 may be utilized and the connective aluminum shape 22 need only be provided along portions of the perimeter sufficient to provide the proper level of connection to the curtain wall frame 28. The connective aluminum shape 22 includes a relatively planar surface, which is bonded to the glass pane assembly 12 by means of the structural silicone 24. The connective aluminum shape 22 also includes an inward facing recessed slot 26.

Attached to a structurally sound portion of the building is a curtain wall frame support structure 28. The curtain wall frame support structure 28 includes a base plate 30, which is the portion of the curtain wall frame support structure 28 that is secured to an element of the building's structure. Base plate 30 will be configured so that it properly coincides with whichever curtain wall frame support structure 28 it is intended to be attached to. For example, base plate 30 may be caused to be attached to a girder or beam. Depending from base plate 30 is a support beam 32. Support beam 32 terminates in a support pad 38, which, in the preferred embodiment, is substantially parallel to the base plate 30. An outward facing leg 36 projects from the support pad 38 and a clamp extension pad 34 is provided adjacent to the leg 36.

The glass pane assembly 12 and the connective aluminum shape 22 is securely bonded with structural silicone 24 to the inside portion of the glass pane assembly 12. This will be typically done within a factory in well-controlled conditions. To install the combination of the glass pane assembly 12 and connective aluminum shape 22 it is then manipulated so that the outward facing leg 36 is indexed into the slot recess 26. Subsequently a clamp, such as a snap clamp 40, is caused to bind the lower profiled portion of the connective aluminum shape 22 with the clamp extension pad 34. The connective aluminum shape 22 and the clamp extension pad 34 may be configured to provide interlocking channels so that the clamp 40 securely grips each element when locked in place. Similarly, the clamp 40 could be made in a wide variety of shapes and configurations while still achieving its intended purpose. A tool such as lever 42 may be used to assist the installer in attaching the snap clamp 40 to the connective aluminum shape 22 and clamp extension pad 34. The snap clamp 40 may be as long or as short as desired, and as many such clamps 40 can be utilized around the perimeter of the connective aluminum shape 22 as necessary to retain the glass pane assembly 12 in place. Appropriate sealing material 44 is then placed between the interior face of pane 16 of glass pane assembly 12, the inside portion of connective aluminum shape 22, and the curtain wall frame support structure 28. Furthermore, a secondary seal 46 may be provided between curtain wall frame support structure 28 and connective aluminum shape 22. Curtain wall frame support structure 28 will be provided around at least a portion of the perimeter for each glass pane assembly 12 opening. A gap may optionally be left between each glass pane assembly 12 opening thus gap 48 is created between adjacent curtain wall frame support structures 28. Gap 48 can be cosmetically concealed as desired.

Figure 2:
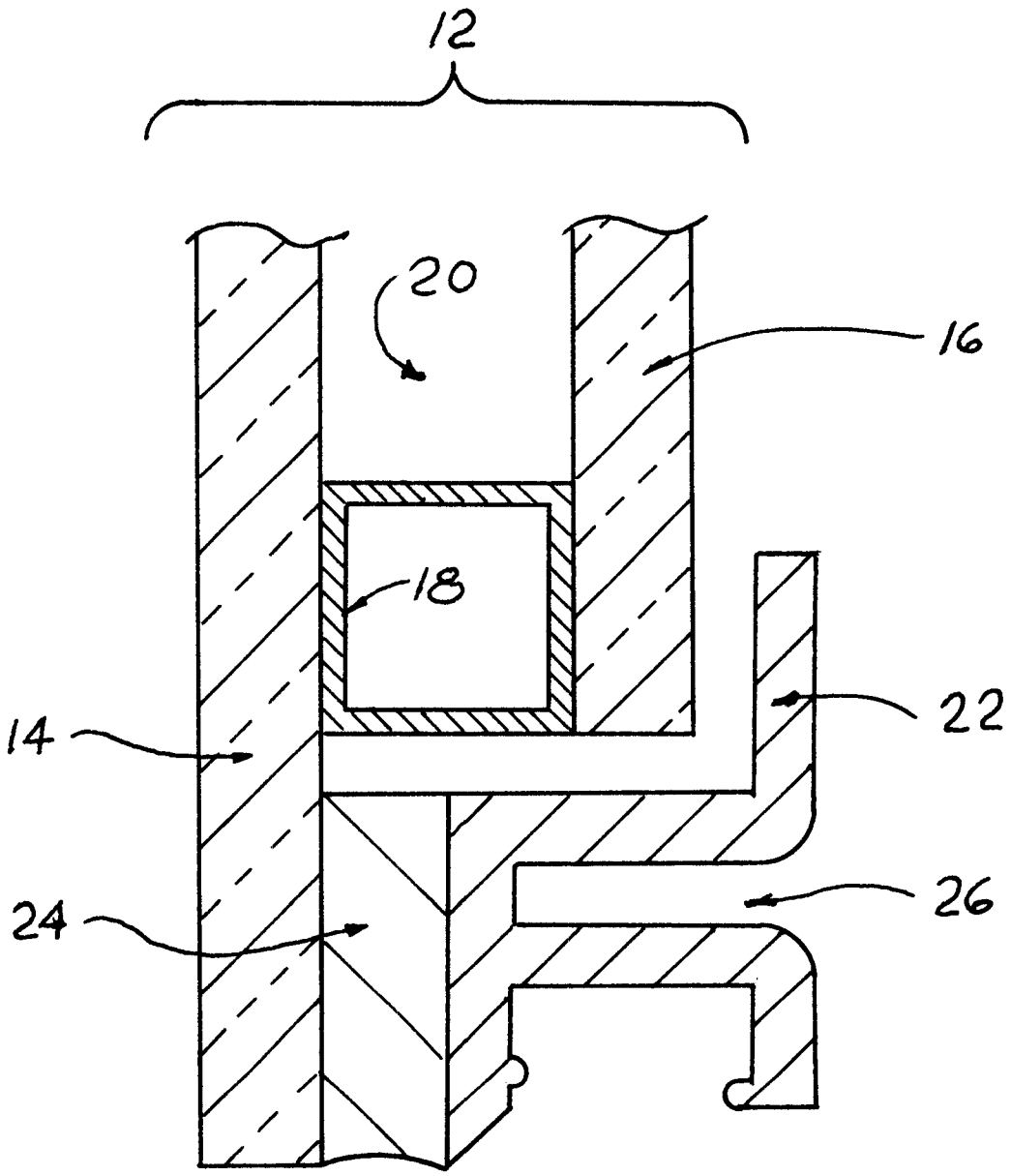
FIG. 2 is a partial side sectional view of a glass pane assembly having a connective aluminum shape bonded thereto.

Referring to FIG. 2, glass pane assembly 12 having inner and outer glass panes 14 and 16 separated by spacer 18 are shown as bonded to connective aluminum shape 22 by structural silicone 24. The connective aluminum shape 22 may be bonded to glass pane assembly 12 in this fashion at any desired location. Due to the ability to bond the glass pane assembly 12 and connective aluminum shape 22 into a unit that can be easily transported, it is possible and desirable to bond the connective aluminum shape 22 to the glass pane assembly 12 under factory conditions. This will assure accurate alignment and a clean and durable bond.

Figure 3:
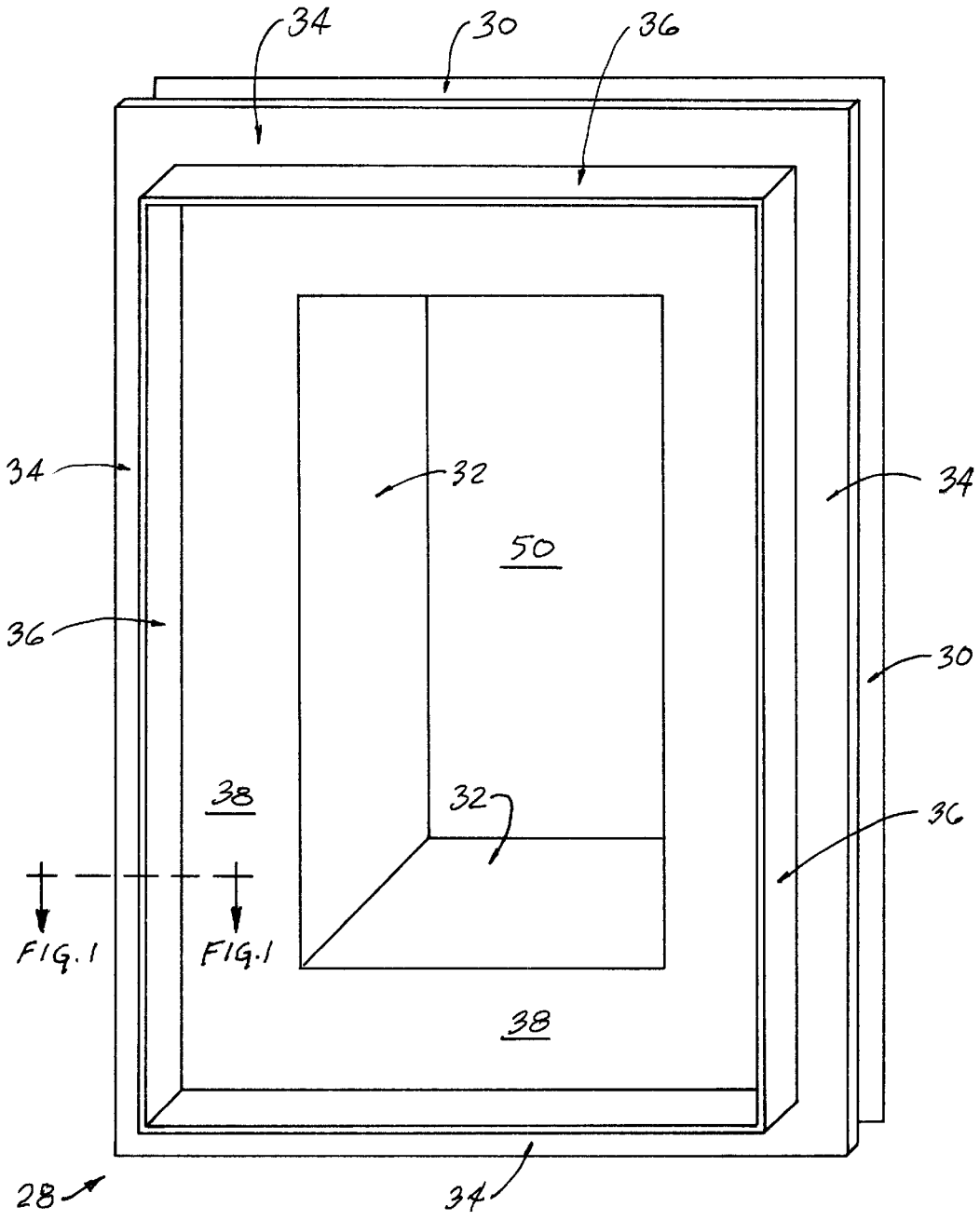
FIG. 3 is a perspective view of a rectangular curtain wall frame support structure.

Referring to FIG. 3, a perspective view of curtain wall frame support structure 28 is provided. Glass pane assembly 12 opening 50 is surrounded by base plate 30, which includes support beam 32. The support pad 38 depends from support beam 32. Projecting from the relatively planar surface of the support pad 38 is out facing leg 36, which is shown to surround the entire perimeter of the Glass pane assembly 12 opening 50. As previously discussed out facing leg 36 or any other portion of the curtain wall frame support structure 28 can be caused to surround the entire perimeter of the glass pane assembly 12 opening 50 or any portion thereof. Substantially coplanar with support pad 38 is clamp extension pad 34 which extends beyond out facing leg 36 on the opposite side of support pad 38.

Figure 4:
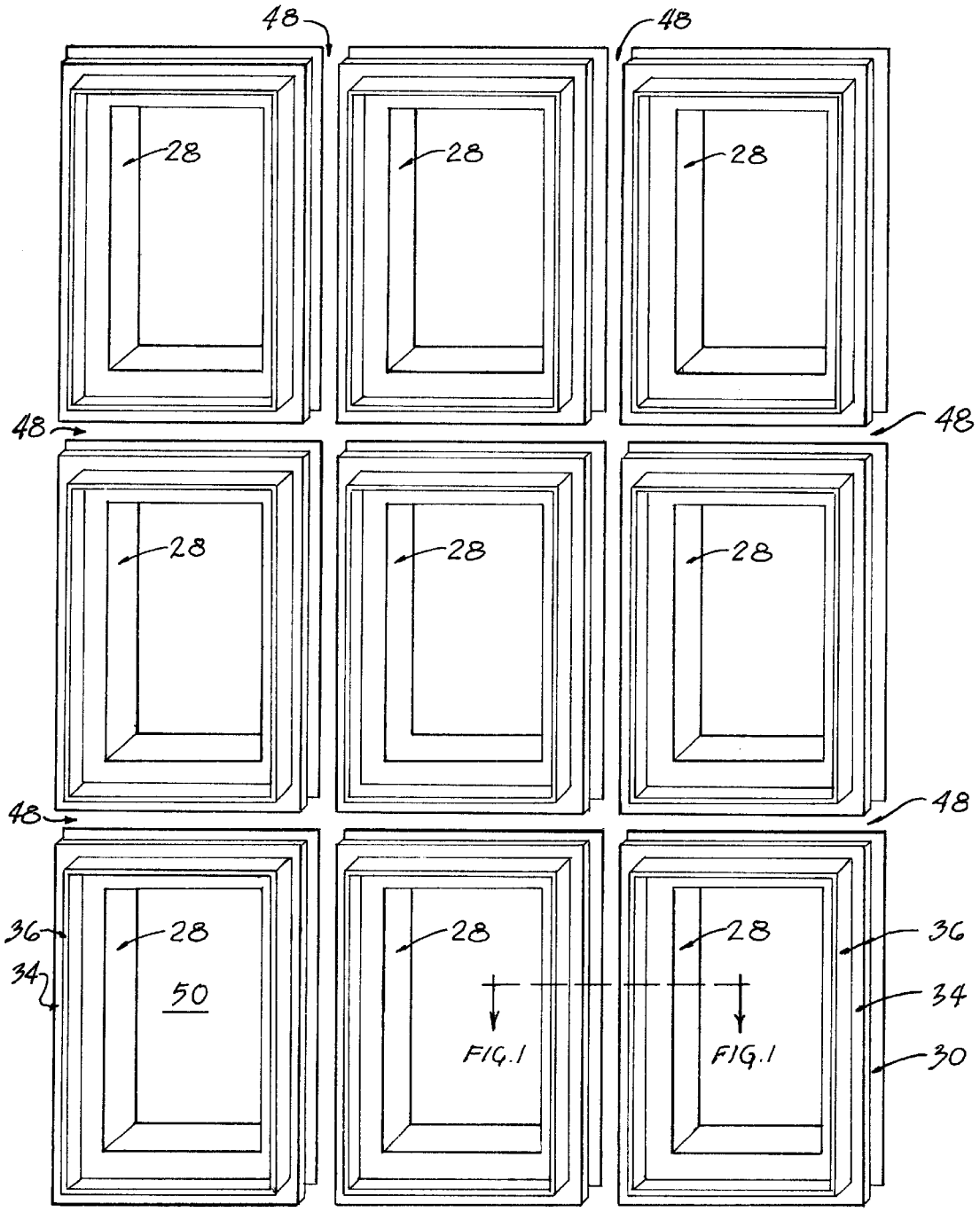
FIG. 4 is a perspective view of a plurality of curtain wall frame support structures arranged in a symmetric pattern.

FIG. 4 illustrates how a plurality of curtain wall frame support structures 28 can be arranged in a symmetric pattern on a building structure. Sufficient space is provided to install the glass pane assembly 12 and connective aluminum shape 22 to the curtain wall frame structures 28. Specifically space is provided between adjacent curtain wall frame support structures 28 about gaps 48 so that as each glass pane assembly 12 and connective aluminum shape 22 is put in place, the installer can secure it with snap clamps 40. Similarly, the spacing allows for replacement of the glass pane assembly 12 with structural silicone in the future.

Figure 5:
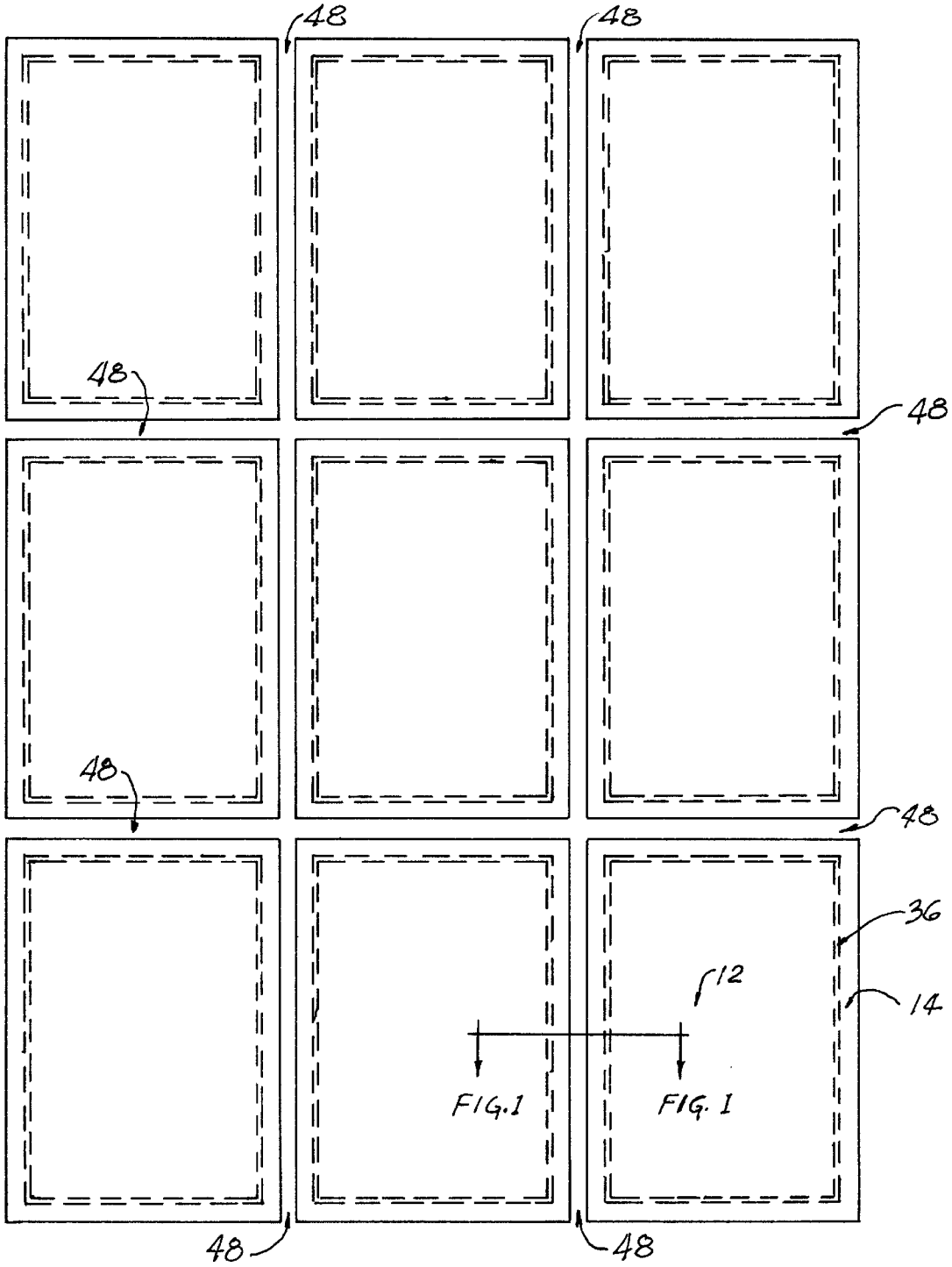
FIG. 5 is a schematic diagram illustrating a plurality of glass pane assemblies installed to a plurality of curtain wall frame support structures arranged in a symmetric pattern.

FIG. 5 is a schematic diagram illustrating a completed glass curtain wall. A plurality of glass pane assembles 12 have their outer pane 14 exposed. This becomes the visible portion of the glass curtain wall. Structural gaps 48 are also visible. Depending on the degree of tinting, various portions of the underlying curtain wall support structure 10 may be visible. Here out facing leg 36 is represented by a dashed line, illustrating how movement parallel to the major plane of the glass pane assemblies 12 would be precluded.

Those skilled in the art of curtain wall design will further appreciate that the present invention may be embodied in other specific forms without departing from the spirit of central attributes thereof. In that the foregoing description of the present invention discloses only exemplary embodiments thereof, it is to be understood that other variations are contemplated as being within the scope of the present invention. Accordingly, the present invention is not limited in the particular embodiments, which have been described in detail therein. Rather, reference should be made to the appended claims as indicative of the scope and content of the present invention.

What is claimed is:

1. A prefabricated window assembly for a building, said window assembly comprising:

a curtain wall frame having a support pad, a clamping extension and a outward facing leg extending generally perpendicularly away from said support pad;

a glass assembly including at least one pane of glass;

a connective aluminum frame member having, in cross section, a generally planar base portion and two leg portions extending generally perpendicularly with respect to the base portion, each of said leg portions including an extension member extending generally perpendicularly with respect to said leg portion, said base portion being disposed parallel to and bonded to said at least one pane of glass with a structural silicone adhesive, said two leg portions and said base portion forming a slot which faces generally perpendicularly away from said at least one pane of glass toward said curtain wall frame, said slot receiving said outward facing leg of the curtain wall frame for positioning said connective aluminum frame member with respect to said curtain wall frame;

a generally L-shaped clamp having one portion attached to said clamping extension and another portion attached to said extension member of one of said leg portions such that said clamp clamps said support pad to said connective aluminum frame member.

2. A prefabricated window assembly as set forth in claim 1 wherein said at least one pane of glass can be replaced without disconnecting the connective aluminum frame member from the curtain wall frame.

* * * * *